US008721280B2

(12) United States Patent
Nakagawa et al.

(10) Patent No.: US 8,721,280 B2
(45) Date of Patent: May 13, 2014

(54) PROPELLER FAN

(75) Inventors: Suguru Nakagawa, Sakai (JP); Jirou Yamamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 797 days.

(21) Appl. No.: 12/746,742

(22) PCT Filed: Jan. 5, 2009

(86) PCT No.: PCT/JP2009/050008

§ 371 (c)(1),
(2), (4) Date: Jun. 7, 2010

(87) PCT Pub. No.: WO2009/087985

PCT Pub. Date: Jul. 16, 2009

(65) Prior Publication Data

US 2010/0266428 A1 Oct. 21, 2010

(30) Foreign Application Priority Data

Jan. 7, 2008 (JP) ..... 2008-000452
Dec. 18, 2008 (JP) ..... 2008-322641

(51) Int. Cl.
*F04D 29/38* (2006.01)

(52) U.S. Cl.
USPC ..... 415/222; 416/236 R

(58) Field of Classification Search
USPC ..... 415/228, 222; 416/235, 236 R, 237
See application file for complete search history.

(56) References Cited

U.S. PATENT DOCUMENTS 1,366,635 A * 1/1921 Conway ..... 416/236 R
2,013,473 A * 9/1935 Meyer et al. ..... 416/235
2,238,749 A * 4/1941 Peltier ..... 416/203
2,265,788 A * 12/1941 Wolf, Sr. et al. ..... 416/236 R
2,899,128 A * 8/1959 Vaghi ..... 415/222
4,822,249 A * 4/1989 Eckardt et al. ..... 415/235
6,280,144 B1 * 8/2001 Powers ..... 416/236 A
7,484,937 B2 * 2/2009 Johann ..... 416/228
8,083,487 B2 * 12/2011 Wood et al. ..... 416/223 R
2010/0322779 A1 * 12/2010 Nakagawa et al. ..... 416/241 R
2010/0329879 A1 * 12/2010 Presz et al. ..... 416/228

FOREIGN PATENT DOCUMENTS

CN 1406319 A 3/2003
CN 1616832 A 5/2005
CN 2864168 Y 1/2007
EP 1357296 B1 6/2006

(Continued)

*Primary Examiner* — Christopher Verdier
(74) *Attorney, Agent, or Firm* — Birch, Stewart, Kolasch & Birch, LLP.

(57) ABSTRACT

A propeller fan includes a hub 1 and a plurality of blades 2, which are radially arranged on the outer circumference of the hub 1. A plurality of bent surface-shaped recesses 21 to 23 are formed on the positive pressure surface at a trailing edge 2*b* of each blade 2. The recesses 21 to 23 extend in the rotation direction of the fan and are arranged in a radial direction. Protrusions 24, 25 are each formed between adjacent pair of the recesses 21 to 23. The bent surfaces of the recesses 21 to 23 and the protrusions 24, 25 reduces air flow caused by centrifugal force. This allows the air flow on the positive pressure surface of the blade 2 to easily flow along the recesses 21 to 23. As a result, air flow does not concentrate on the outer periphery of the blade 2, which reduces the differences in the velocity and volume of air flow between the outer tip 2*c* of the blade 2 and the hub 1. Accordingly, the blade 2 functions as a whole. Therefore, the air blowing performance (efficiency and air blowing noise) of the propeller fan is improved.

11 Claims, 10 Drawing Sheets

(56) References Cited

FOREIGN PATENT DOCUMENTS

| | | | |
|---|---|---|---|
| JP | 56-143594 | U | 10/1981 |
| JP | 2-61400 | A | 3/1990 |
| JP | 5-44695 | A | 2/1993 |
| JP | 5-501902 | A | 4/1993 |
| JP | 8-121386 | A | 5/1996 |
| JP | 8-177792 | A | 7/1996 |
| JP | 2000-110785 | A | 4/2000 |
| JP | 2002-371994 | A | 12/2002 |
| JP | 2003-227302 | A | 8/2003 |
| JP | 2007-292053 | A | 11/2007 |
| WO | WO 92/05341 | A1 | 4/1992 |
| WO | WO 03/072948 | A1 | 9/2003 |

* cited by examiner

PROPELLER FAN

TECHNICAL FIELD

The present invention relates to a structure of a propeller fan having a function of reducing radially outward flow due to centrifugal force, and more particularly to the structure of the blades of the propeller fan.

BACKGROUND ART

The conventional propeller fan includes a hub 1 and a plurality of blades 2 attached to the hub 1 as shown in FIGS. 18 and 19. Each blade 2 is formed to be flat as a whole from a leading edge 2*a* to a trailing edge 2*b*. Radially outward air flow due to centrifugal force generated by rotation of the fan tends to concentrate air flow to the outer periphery of each blade 2 (refer to Patent Document 1).

This causes the following problems.

(1) The flow pattern on the blade surface of each blade 2 changes depending on the operating state of the propeller fan.

(2) When the operating state of the propeller fan changes, the warpage of each blade 2 and the flow pattern cease according with each other. This degrades the performance of the propeller fan.

Particularly, in the case of a semiopen type propeller fan in which only part of each blade 2 is surrounded by a bellmouth 4 as illustrated in FIGS. 18 and 19, a velocity component in the radial direction of air flow changes significantly in a region on the inlet side of the blade 2.

(3) In the downstream region of the blades 2 surrounded by the bellmouth 4, the state of air flow changes to various forms including a centripetal flow, a flow along the rotation shaft of the fan, and an outward flow.

(4) When the air flow resistance of the propeller fan is great, outward air flow is likely to be generated. Therefore, air flow is concentrated in the outer peripheral region of each blade 2, and the blade 2 does not function effectively in a region in the vicinity of the hub 1.

For the reasons discussed above, the blowing performance of the propeller fan is reduced.

In this regard, a fan has been disclosed in which a plate-like rib is provided on the positive pressure surface of each blade in a radially outer end (blade tip), which is not surrounded by a bellmouth (refer to Patent Document 2). The height of the rib becomes gradually greater from the inlet side toward the outlet side of the blade 2.

However, in a fan having this structure, although leakage vortex flowing from the positive pressure surface to the negative pressure surface of each blade at the radially outer tip is reduced, radially outward air flow caused by the centrifugal force cannot be reduced.

Patent Document 1: International Publication WO2003/072948

Patent Document 2: Japanese Laid-Open Patent Publication No. 5-44695

DISCLOSURE OF THE INVENTION

Accordingly it is an objective of the present invention to provide a propeller fan that effectively reduces outward air flow caused by centrifugal force.

To achieve the foregoing objective and in accordance with one aspect of the present invention, a propeller fan including a hub coupled to a fan motor serving as a drive source and a plurality of blades provided on the outer circumference of the hub is provided. The blades extends radially outward. The propeller fan further includes a plurality of recesses and a plurality of protrusions. The recesses each have a recessed surface, extend circumferentially on a positive pressure surface at a trailing end of each blade, and are aligned in the radial direction. The protrusions are each located between adjacent two of the recesses.

According to the above configuration, outward air flow from the hub to the outer tip of the blade due to centrifugal force is effectively reduced by recesses and protrusions.

That is, in this configuration, a radial component of the air flow on the positive pressure surface of the blade caused by centrifugal force is pressed against the recessed surfaces of the recesses and the wall surfaces of the protrusions, so that outward flow is effectively reduced. This allows the air flow on the positive pressure surface of the blade to easily flow along each recess.

As a result, air flow does not concentrate on the outer periphery of the blade, which reduces the differences in the velocity and volume of air flow between the outer periphery of the blade and the hub. Therefore, the volume of air flow near the hub is increased while the volume of air flow at the outer periphery of the blade is reduced. As a result, the propeller fan has a uniform performance over the entire radial direction of the blades.

The recessed surface of the recess is preferably a curved surface.

This configuration effectively reduces outward flow from the hub to the outer tip of the blade by means of the recesses formed of curved surfaces and the protrusions.

Each recessed portion is preferably a bent portion.

This configuration effectively reduces outward flow from the hub to the outer tip of the blade by means of the recesses formed of bent portions and the protrusions.

Each recess preferably has an arcuate cross-section.

This configuration effectively reduces outward flow from the hub to the outer tip of the blade by means of the recesses having an arcuate cross section and the protrusions.

Each blade preferably has a negative pressure surface located on the opposite side from the positive pressure surface, and a plurality of protrusions are preferably formed on the negative pressure surface at the trailing end of the, in which each protrusion corresponds to one of the recesses.

Accordingly, even in a case of a thin blade that is formed to have a wavy trailing edge, recesses having sufficient depths and protrusions having sufficient heights can be formed on the positive pressure surface of the blade.

Therefore, outward flow from the hub toward the outer tip of the blade is reliably reduced by the sufficiently deep recesses and the sufficiently high protrusions.

The recesses preferably have different widths in a radial direction.

Accordingly, even if the radial widths of the recesses vary, radially outward air flow is effectively reduced.

The widths of the recesses are preferably formed to decrease in a radial direction as the distance from the hub increases and toward the outer periphery of the corresponding blade.

Accordingly, flow from the hub toward the outer periphery, the flow rate of which increases in accordance with an increase in the centrifugal force, can be reliably controlled by the recesses, the widths of which gradually decrease from the hub toward the outer periphery of the blade, and the protrusions.

The recesses preferably have different depths.

Accordingly, even if the depth of each row of the recesses vary, radially outward air flow is effectively reduced.

The depths of the recesses are preferably formed to decrease as the distance from the hub increases and toward the outer periphery of the corresponding blade.

Accordingly, flow from the hub toward the outer periphery, the flow rate of which increases in accordance with an increase in the centrifugal force, can be reliably controlled by the recesses, the depths of which gradually decrease from the hub toward the outer periphery of the blade, and the protrusions.

A bellmouth adapted for surrounding the blades is preferably provided at a position radially outward of the blades, and each blade preferably has a chord length extending from a leading edge to a trailing edge. Each recess is preferably provided in a region at the trailing edge of the corresponding blade, and the region is preferably rearward of a substantially middle point of the chord length of the blade.

Accordingly, in the case of a semiopen type propeller fan, in which a bellmouth surrounds part of each blade, the radial component of the velocity of air flow changes significantly on the inlet side surface of each blade. Therefore, in the downstream region surrounded by the bellmouth, the state of air flow changes to various forms including a centripetal flow, a flow along the rotation shaft of the fan, and a radially outward flow. If the recesses are provided in a region surrounded by the bellmouth, the air flow that leaks from the positive pressure surface to the negative pressure surface through a gap between the bellmouth and the blade tips is reduced. This reduces the blade tip vortex.

Each blade preferably has a chord length extending from a leading edge to a trailing edge, and the size of each recess preferably gradually decreases toward middle point of the chord length, such that the recess merges into the same surface as the positive pressure surface of the corresponding blade.

Accordingly, in a region from the leading edge to a center in the chord length of the blade, the volume of air flow in the radial direction is still small, and the difference in the velocity of the air flow between the vicinity of the hub and the outer periphery of the blade is small. In this region, the volume of smooth air flow from the leading edge to the trailing edge of the blade is greater than the volume of radially outward air flow. Therefore, in this region, the original flat blade surface functions effectively. On the other hand, in a region downstream of the above discussed region, the action of the centrifugal force is great and the volume of air flow from the hub toward the outer periphery of the blade is great. This starts creating differences in the volume and velocity of air flow between the vicinity of the hub and the outer periphery of the blade. In an area downstream of this area, the size of the recesses described above is gradually increased, the radial flow is appropriately reduced in accordance with the flow rate.

Each blade preferably has a chord length extending from a leading edge to a trailing edge, and the each recess is preferably formed in a region ranging from 30% to 100% of the chord length from the leading edge of the corresponding blade.

This configuration properly achieves reduction of the air flow in the radially outward direction.

The recesses are preferably formed in a part of a region ranging from 0% to 85% of the distance from the hub to the outer periphery of the corresponding blade.

This configuration properly achieves reduction of the air flow in the radially outward direction.

The recesses are preferably formed in the entirety a region ranging from 0% to 85% of the distance from the hub to the outer periphery of the corresponding blade.

This configuration properly achieves reduction of the air flow in the radially outward direction.

As described above, the present invention maximizes the air blowing performance (efficiency and air blowing noise) of the propeller fan.

BEST MODE FOR CARRYING OUT THE INVENTION (First Embodiment)

With reference to FIGS. 1 to 5, a propeller fan according to a first embodiment of the present invention will be described. The propeller fan is suitable, for example, for an air blower of an air conditioner out door unit.

Figure 1:
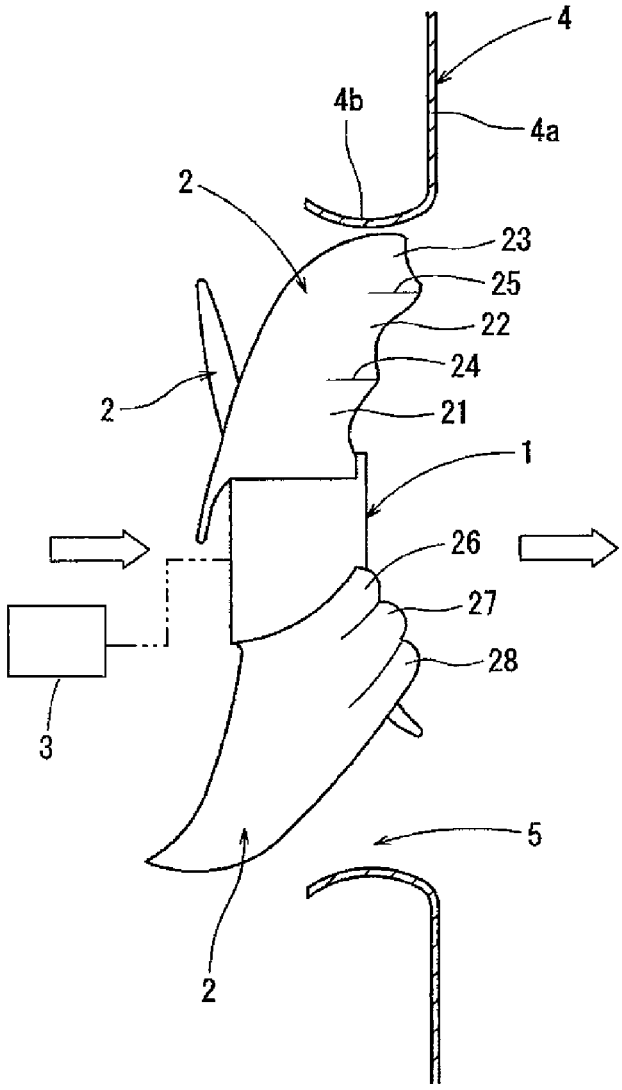
FIG. 1 is a longitudinal cross-sectional view illustrating the entire structure of a propeller fan according to a first embodiment of the present invention.
Figure 2:
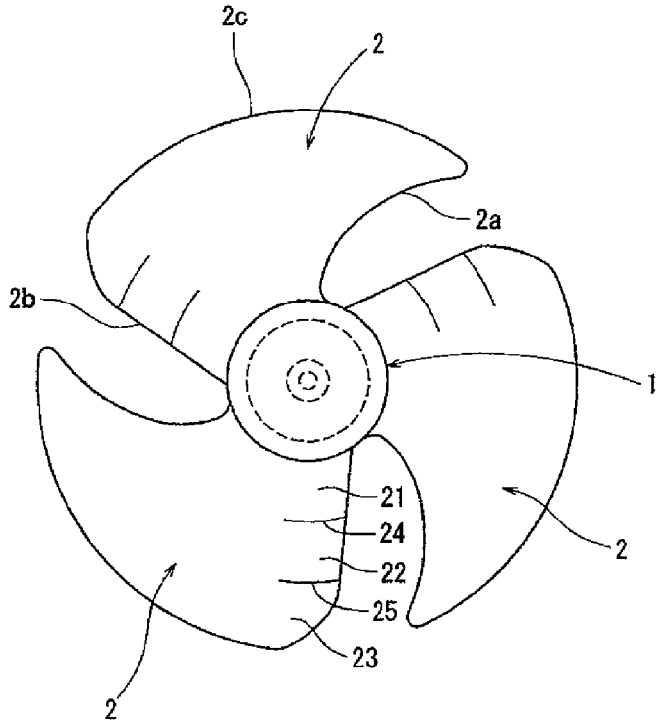
FIG. 2 is a front view showing the positive pressure surface of the impeller of the propeller fan shown in FIG. 1.
Figure 3:
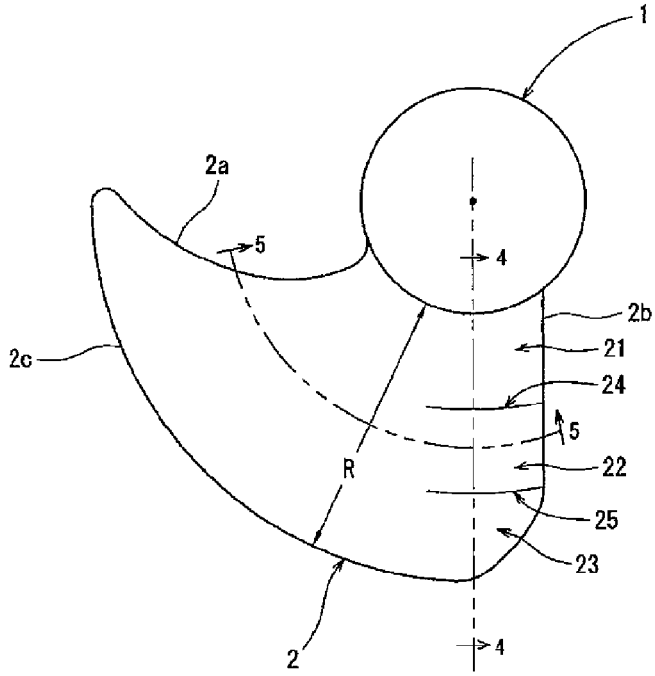
FIG. 3 is an enlarged front view illustrating a blade of the impeller shown in FIG. 2.

In FIGS. 1 and 2, a propeller fan (air blower) is coupled to a fan motor, which is a drive source, and includes a cylindrical hub 1 made of synthetic resin. The hub is the rotation center of the propeller fan. A plurality of blades 2 (three in the present embodiment) are integrally formed with the outer circumferential surface of the hub 1.

A bellmouth 4, which is formed in a partition plate ofthe outdoor unit, is provided about the hub 1 and the blades 2. The bellmouth 4 is formed by a plate portion 4*a* and a cylindrical portion 4*b* (an air flow guide for inlet and outlet). A predetermined space (clearance) 5 exists between the inner circumferential surface of the cylindrical portion 4*b* and the outer tips 2*c* of the blades 2. An upstream region of the space 5 serves as an air inlet port, and a downstream region of the space 5 serves as an air outlet port.

In this propeller fan, the impeller is arranged with respect to the cylindrical portion 4*b* with a predetermined clearance such that a predetermined width of the trailing edge 2*b* of each blade 2 overlaps with the cylindrical portion 4*b* of the bellmouth 4. This increases the static pressure and the dynamic pressure in the space 5, and thus maximizes the effective air blowing performance.

In order to solve the problem of decreased air blowing performance of the conventional fan, which has been discussed above, the propeller fan according to the present embodiment is characterized by the shape of the blade 2. For example, as illustrated in detail in FIGS. 3 and 4, a plurality of (three in the present embodiment) of recesses 21 to 23 are coaxially formed on the positive pressure surface at the trailing edge 2*b* of each blade 2. The recesses 21 to 23 each have an arcuate cross-section and a predetermined depth. Also, protrusions 24, 25 having a predetermined height are each formed between adjacent ones of the recesses 21 to 23.

Figure 4:
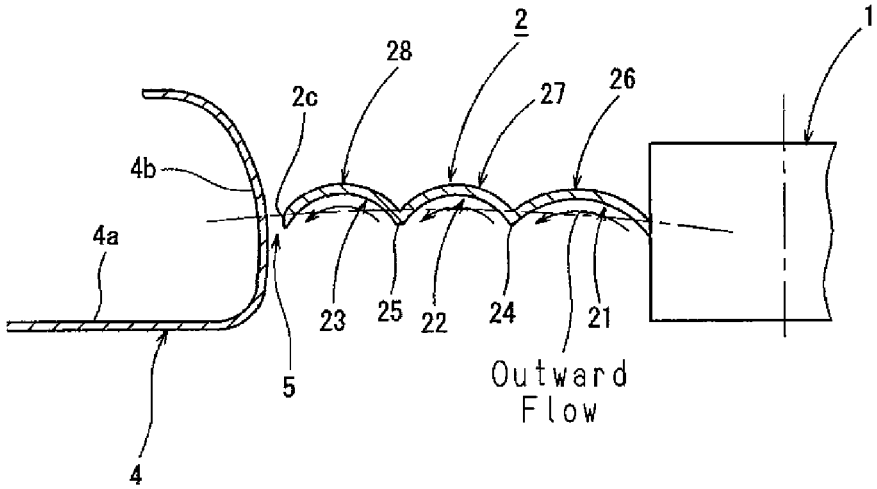
FIG. 4 is a partial cross-sectional view taken along line 4-4 of FIG. 3, illustrating the impeller blade.
Figure 5:
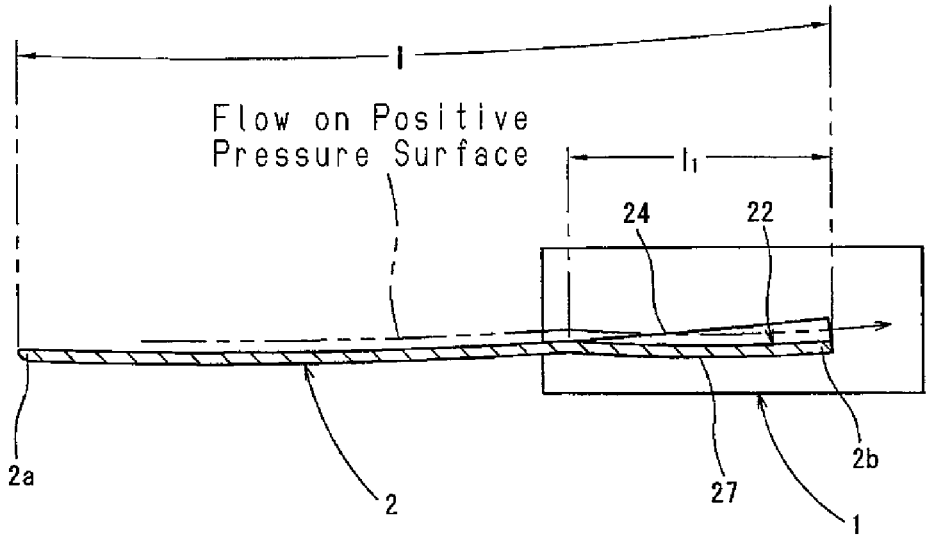
FIG. 5 is a partial cross-sectional view taken along line 5-5 of FIG. 3, illustrating the impeller blade.

In this configuration, the concave surfaces of the recesses 21 to 23 and the protrusions 24 and 25 effectively suppress radially outward air flow caused by centrifugal force, that is, outward air flow from the hub 1 to the outer tip 2*c* of the blade 2 (refer to the arrows in FIG. 4).

That is, according to this configuration, radial air flow caused by centrifugal force on the positive pressure surface of the blade 2 is pressed against the concave surfaces of the recesses 21 to 23 and the walls of the protrusions 24 and 25 outside of the recesses 21 to 23, which reduces the velocity of the air flow. Accordingly, the outward air flow is effectively reduced. This allows the air flow on the positive pressure surface of the blade 2 to easily flow along the recesses 21 to 23 having an arcuate cross-section.

As a result, air flow does not concentrate in the outer peripheral region of the blade 2, which reduces the difference in the velocity and volume of the air flow between the outer peripheral region of the blade 2 and the region in the vicinity of the hub 1. Accordingly, the volume of air flow in the region of the blade 2 in the vicinity of the hub 1 is increased, while the volume of air flow in the outer peripheral region of the blade 2 is reduced. As a result, the blade 2 has a uniform performance over the entire radial direction of the blades. Also, in the outer periphery of the blade 2, the air flow that leaks from the positive pressure surface to the negative pressure surface through the clearance of the bellmouth 4 is reduced. This reduces the blade tip vortex.

As described above, the air blowing performance (efficiency and air blowing noise) of the propeller fan is improved.

Further, according to the present embodiment, protrusions 26 to 28 each having an arcuate cross-section are formed on the negative pressure surface at the trailing edge 2*b* of the blade 2. The protrusions 26 to 28 correspond to the recesses 21 to 23, which are formed on the positive pressure surface of the blade 2 and have an arcuate cross-section.

In this configuration, the trailing edge 2*b* of the blade 2 is formed to have a wavy shape from the hub 1 to the outer tip 2*c*. Therefore, in the case of the thin blade 2 as illustrated, the recesses 21 to 23 having sufficient depths and the protrusions 24 and 25 having sufficient heights can be easily formed on the positive pressure surface of the blade 2.

Therefore, the recesses 21 to 23 and the protrusions 24 and 25 can be formed easily, and outward air flow from the hub 1 to the outer tip 2*c* of the blade 2 due to centrifugal force can be reliably reduced by the recesses 21 to 23 having sufficient depths and the protrusions 24 and 25 having sufficient heights.

In the present embodiment, the recesses 21 to 23 are formed in a portion surrounded by the bellmouth 4 in a region closer to the trailing edge than the substantial center in the chord length that passes through the camber line of the trailing edge 2*b* of the blade 2.

As described above, in the case of a semiopen type propeller fan, in which the bellmouth 4 surrounds part of each blade 2, the radial component of the velocity of air flow changes significantly on the inlet side region of the blade 2. Therefore, in the downstream region of the blades 2 surrounded by the cylindrical portion 4*b* of the bellmouth 4, the state of air flow changes to various forms including a centripetal flow, a flow along the rotation shaft of the fan, and an outward flow.

However, since the above described recesses 21 to 23 are formed in a portion that is surrounded by the cylindrical portion 4*b* of the bellmouth 4, the air flow that leaks from the positive pressure surface to the negative pressure surface through the clearance of the bellmouth 4 is reduced in the outer periphery of the blade 2. This sufficiently reduces the blade tip vortex.

Also, the sizes of the recesses 21 to 23 are gradually reduced at a center in the chord length of the blade 2, at which the recesses 21 to 23 merge into the same flat surface of the blade 2.

According to this configuration, in a region from the leading edge to the center in the chord length of the blade 2, the volume of air flow in the radial direction is still small, and the difference in the velocity of the air flow between the hub 1 and the outer periphery of the blade 2 is small. In this region, the volume of smooth air flow from the leading edge to the trailing edge of the blade 2 is greater than the volume of radially outward air flow. Therefore, in this region, the original flat surface of the blade 2 functions effectively. On the other hand, in an area closer to the trailing edge of the blade 2 than the center of the chord length, the action of the centrifugal force is great and the volume of air flow from the hub 1 toward the outer periphery of the blade 2 is great. This starts creating differences in the volume and velocity of air flow between the vicinity of the hub 1 and the outer periphery of the blade 2. In this region, the sizes of the above described recesses 21 to 23 are gradually increased so that the radially outward air flow is properly reduced in accordance with its flow rate.

Also, the area in which the recesses 21 to 23 preferably ranges from 30% to 100% of the circumferential distance between the leading edge 2*a* and the trailing edge 2*b* (on the camber line at each position in the radial direction). In other words, the area preferably ranges from 30% to 100% of the chord length from its leading end (the range in which $l_1/l$ in FIG. 5 satisfies the inequality $0<l_1/l\leq 0.7$).

Further, the above described recesses 21 to 23 are preferably formed in a part of a region from 0% to 85% of the distance R between the hub 1 and the outer tip 2*c* of the blade 2 (refer to FIG. 3), or over the entire region from 0% to 85% of the distance R between the hub 1 and the outer tip 2*c* of the blade 2.

The shape of the recesses 21 to 23 is not limited to arcuate, but may be any type of concave surfaces including a curved surface of a long ellipse or a bent surface in which the curvature of the arcuate surface is changed as necessary.

The shape of the recesses 21 to 23 may be changed in the following embodiments, also.

Hereinafter, other embodiments will be described.

Differences from the first embodiment will mainly be discussed, and the description of the same features as the first embodiment will be omitted.

(Second Embodiment)

In the configuration of the first embodiment, the recesses 21 to 23 on the positive pressure surface and the protrusions 26 to 28 on the negative pressure surface of the blade 2 are formed without changing the contour (edge surface) of the trailing edge 2*b* from the hub 1 to the outer tip 2*c*. Instead, the shape of the trailing edge 2*b* of the blade 2 may be wavy with long waves and short waves. Alternatively, the trailing edge 2*b* may be saw-toothed.

(Third Embodiment)

Figure 6:
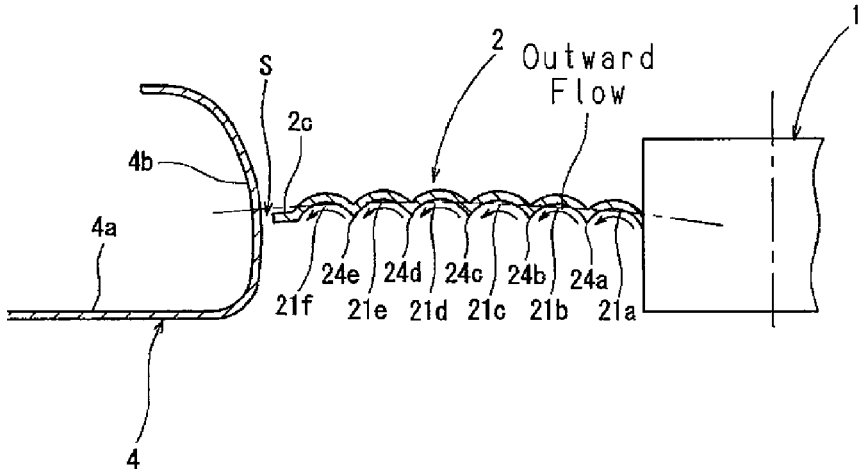
FIG. 6 is a partial cross-sectional view illustrating an impeller of a propeller fan according to a third embodiment of the present invention.

Further, in the first embodiment, the widths and the numbers of the recesses 21 to 23 and the protrusions 24 and 25 may be changed, for example, like recesses 21*a* to 21*f* and the protrusions 24*a* to 24*e* shown in FIG. 6. That is, the widths of the recesses 21*a* to 21*f* and the protrusions 24*a* to 24*e* may be narrower than those in the first embodiment, and the numbers of the recesses 21*a* to 21*f* and the protrusions 24*a* to 24*e* may be greater than those in the first embodiment.

In such a case, the widths of the recesses 21*a* to 21*f* and the protrusions 24*a* to 24*e* may be gradually narrowed from the hub 1 toward the outer tip 2*c* of the blade 2.

(Fourth Embodiment)

Figure 7:
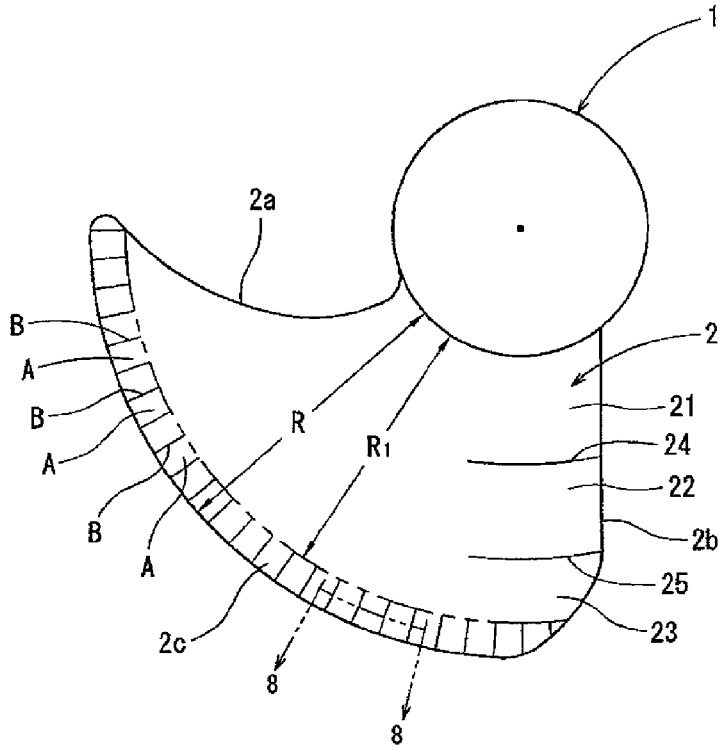
FIG. 7 is a front view illustrating a positive pressure surface of an impeller blade of a propeller fan according to a fourth embodiment of the present invention.
Figure 8:
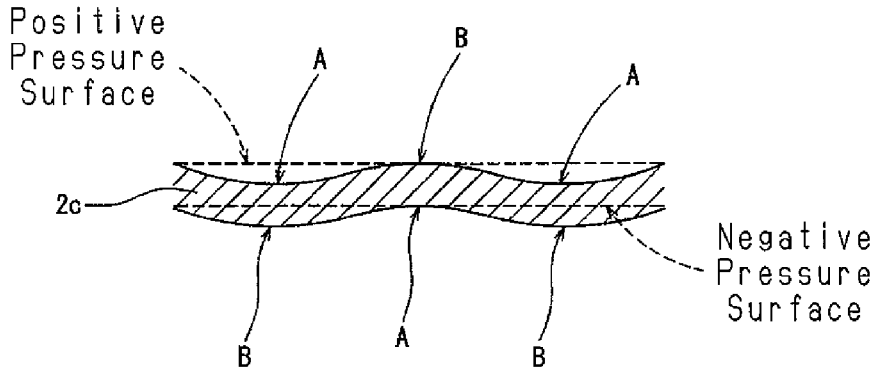
FIG. 8 is a partial cross-sectional view taken along line 8-8 of FIG. 7, illustrating the impeller blade.
Figure 9:
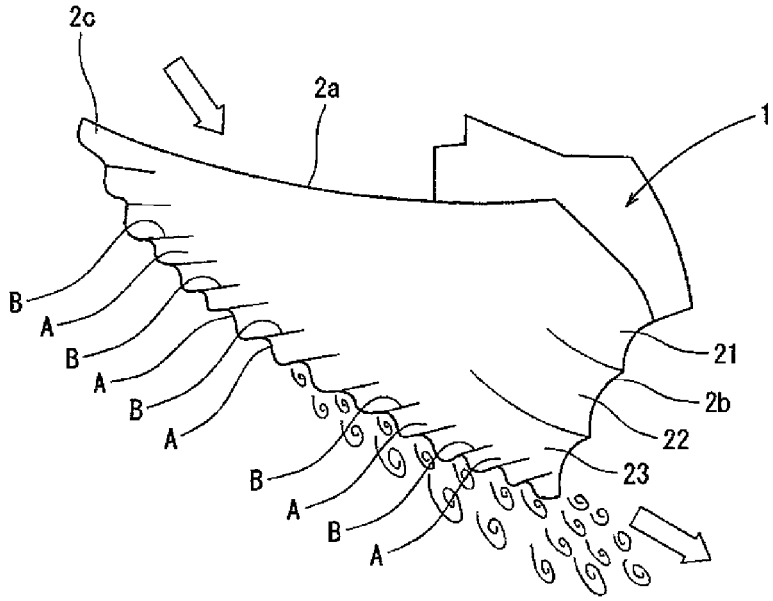
FIG. 9 is a perspective view illustrating reducing action of blade tip vortex in a blade of impeller shown in FIG. 7.

With reference to FIGS. 7 to 9, a propeller fan according to a fourth embodiment of the present invention will be described.

As shown in FIG. 1, which has been discussed above, the bellmouth 4 is located about the blades 2. In the case where a predetermined space 5 exists between the inner circumferential surface of a cylindrical portion of the bellmouth 4 and the outer tip 2*c* of the blade 2, leakage flow from the positive pressure surface to the negative pressure surface is generated in the space 5.

Figure 19:
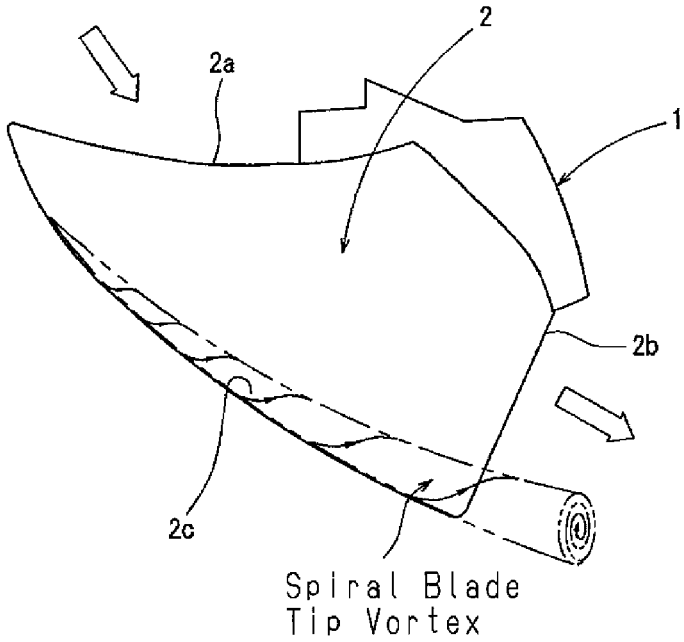
FIG. 19 is perspective view illustrating an impeller blade of the conventional propeller fan, showing a second problem, which occurs at the outer tip of the blade.

If left unchanged, the leakage flow would gradually increase toward the downstream side as shown in FIG. 19 and turn into a spiral blade tip vortex having a large-eddy structure having a common core. As a result, the blowing noise is increased, and the load acting on the fan motor is also increased. This can raise the input power.

To solve such a problem, the present embodiment provides a plurality of recessed surfaces and protruded surfaces are formed on the outer tip 2*c* of the blade as shown in FIG. 7, in place of the configuration of the first embodiment. The recessed surfaces and protruded surfaces are formed both on the positive pressure surface and the negative pressure surface of the blade 2 at predetermined intervals, from a part of the outer tip 2*c* of the blade 2 near the leading edge 2*a* to a part near the trailing edge 2*b* (at least in a range including a point at which air flow starts leaking from the positive pressure surface to the negative pressure surface, the range sufficiently covering the subsequent parts). That is, multiple recesses and protrusions are formed with a plurality of inflection points.

In the present embodiment, grooves A of the recesses of the recessed surfaces and crests B of the protrusions of the protruded surfaces are formed in a predetermined angle range at equal intervals, and extend from the axis of the hub 1 by a predetermined length. In other words, the grooves A and the crests B are formed to extend by a predetermined length in directions of a plurality of straight lines that radially extend from the axis of the hub 1 and are separated by predetermined equal angles.

The grooves A of the recesses and the crests B of the protrusions are formed on the positive pressure surface and the negative pressure surface of the blade 2 by projecting or bending parts of the outer tip 2*c* toward the negative pressure surface with reference to the positive pressure surface of the blade 2 in a flat shape of the blade 2 having no recesses or protrusions (shown by broken lines).

As a result, at the outer tip 2*c* of the blade 2, the alternate and consecutive grooves A of the recesses and crests B of the protrusions form a wavy portion having a constant thickness over the entire length from the leading edge 2*a* to the trailing edge 2*b* of the blade 2.

The wavy outer tip 2*c* of the blade 2 breaks down the continuous leakage flow from the positive pressure surface to the negative pressure surface at the outer tip 2*c* of the blade 2 into discontinuous small flows shown in FIG. 9. This reliably suppresses the development of a blade tip vortex having a common core caused by the leakage flow, which is observed in the conventional configuration.

As a result, the fan noise and the drive load on the fan motor are reduced. This in turn lowers the input power to the fan motor.

Therefore, combined with the suppression of outward flow by the shape of the trailing edge 2*b* of the blade 2 according to the first embodiment and reduction of the leakage vortex from the positive pressure surface to the negative pressure surface, the configuration of the present embodiment provides a propeller fan with a higher blowing performance and blowing efficiency and a lower noise level.

In the present embodiment, the shapes of the recessed surfaces and protruded surfaces may be each formed by a polygonal surface including a plurality of flat areas or by a curved surface. In a case where the recessed surfaces and the protruded surfaces are formed by curved surfaces, air flows smoothly along the curved areas. This allows the vortex to be smoothly divided.

On the other hand, in a case where the recessed surfaces and the protruded surfaces are formed by polygonal surfaces, vortex is more effectively divided.

The recessed surfaces and the protruded surfaces may be formed in a part of or the entirety of the region of 80% to 100% of the distance R between the hub 1 and the outer tip 2*c* of the blade 2 (in a region where $R_1/R$ in FIG. 7 satisfies the inequality $0.8 \leq R1/R \leq 1.0$).

First, even if the recessed surfaces or the protruded surfaces are formed in a part of the region from 80% to 100% of the distance R between the hub 1 and the outer tip 2*c* of the blade 2, a continuous leakage flow flowing from the positive pressure surface to the negative pressure surface of the blade 2 can be divided into discontinuous flows without hindering the main flow of the blade 2. Accordingly, the development of blade tip vortex caused by leakage flow is effectively reduced.

Also, if the recessed surfaces and the protruded surfaces are formed in the entirety of the region, a continuous leakage flow flowing from the positive pressure surface to the negative pressure surface of the blade 2 can be divided into discontinuous flows without hindering the main flow of the blade 2. Accordingly, the development of blade tip vortex caused by leakage flow is further effectively reduced.

(Fifth Embodiment)

Figure 10:
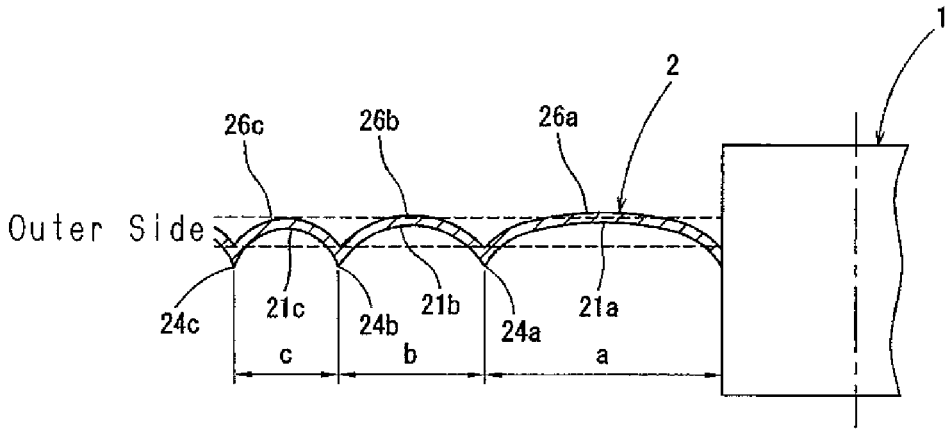
FIG. 10 is a partial cross-sectional view illustrating an impeller blade of a propeller fan according to a fifth embodiment of the present invention.

With reference to FIG. 10, a propeller fan according to a fifth embodiment of the present invention will be described.

According to the present embodiment, a plurality of recesses 21*a* to 21*c* and protrusions 24*a* to 24*c* are formed as shown in FIG. 10. However, the widths of the recesses 21*a* to 21*c* and protrusions 24*a* to 24*c* are different from those of the first embodiment. That is, the present embodiment is characterized in that the radial widths a to c of the recesses 21*a* to 21*c* are gradually reduced as the distance from the hub 1 increases toward the outer tip 2*c* (a>b>c). The recess 21*a*, which is closest to the hub 1, has the greatest width, and the widths of the recesses 21*b*, 21*c* are reduced toward the outer tip 2*c*. In this case, the depths of the concave surface (bent surface) of the recesses 21*a* to 21*c* (the heights of the protrusions 24*a* to 24*c*) are constant.

According to this configuration, outward flow from the hub 1 toward the outer tip 2*c*, the flow rate of which increases in accordance with an increase in the centrifugal force, can be reliably reduced by the recesses 21*a* to 21*c* and the protrusions 24*a* to 24*c*, the widths of which gradually decrease along the radial direction.

Therefore, the recesses 21*a* to 21*c* and the protrusions 24*a* to 24*c* function in the same manner as the recesses 21 to 23 and the protrusions 26 to 28 of the first embodiment, so that the air blowing performance (efficiency and air blowing noise) of the propeller fan is improved.

(Sixth Embodiment)

Figure 11:
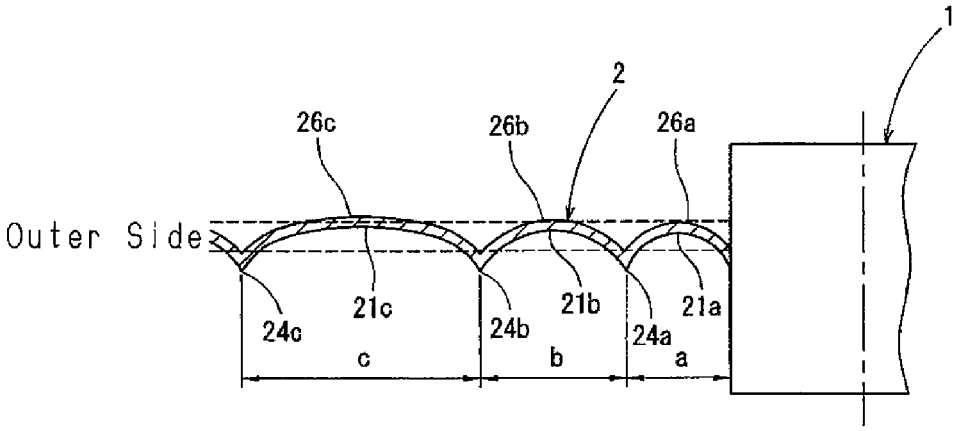
FIG. 11 is a partial cross-sectional view illustrating an impeller blade of a propeller fan according to a sixth embodiment of the present invention.

With reference to FIG. 11, a propeller fan according to a sixth embodiment of the present invention will be described.

The present embodiment is the same as the fifth embodiment except that the radial widths a to c of the recesses 21*a* to 21*c* and the protrusions 24*a* to 24*c* are gradually increased as the distance from the hub 1 increases toward the outer tip 2*c* as shown in FIG. 11 (a<b<c).

According to this configuration, outward flow from the hub 1 toward the outer tip 2*c*, the flow rate of which increases in accordance with an increase in the centrifugal force, can be reliably reduced by the recesses 21*a* to 21*c* and the protrusions 24*a* to 24*c*, the radial widths of which gradually increases.

The present embodiment therefore achieves the same operation as the fifth embodiment, and the air blowing performance (efficiency and air blowing noise) of the propeller fan is improved.

(Seventh Embodiment)

Figure 12:
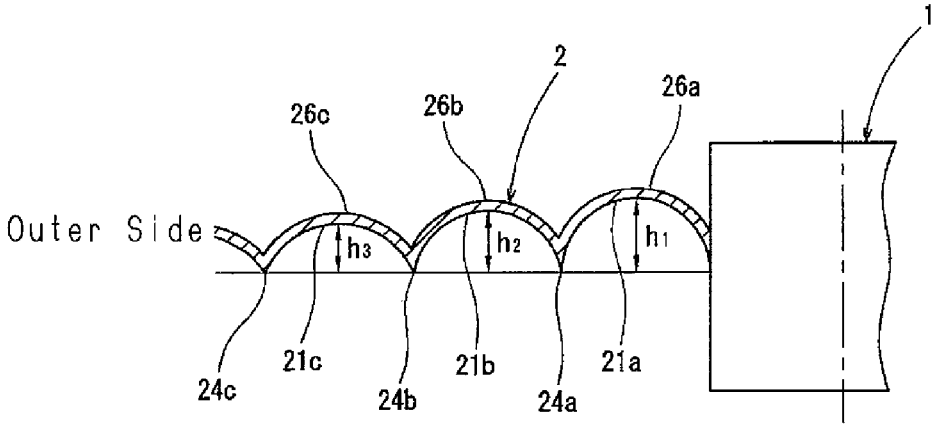
FIG. 12 is a partial cross-sectional view illustrating an impeller blade of a propeller fan according to a seventh embodiment of the present invention.

With reference to FIG. 12, a propeller fan according to a seventh embodiment of the present invention will be described.

In the present embodiment, a plurality of recesses 21*a* to 21*c* and protrusions 24*a* to 24*c* are formed as in the first embodiment as shown in FIG. 12. The present embodiment is different from the first embodiment in that the depths $h_1$ to $h_3$ of the recesses 21*a* to 21*c* are gradually reduced as the distance from the hub 1 increases toward the outer tip 2*c* ($h_1>h_2>h_3$). In this case, the widths of the bent surface of the recesses 21*a* to 21*c* (the interval between the protrusions 24*a* to 24*c*) are constant.

According to this configuration, outward flow from the hub 1 toward the outer tip 2*c*, the flow rate of which increases in accordance with an increase in the centrifugal force, can be reliably reduced by the recesses 21*a* to 21*c* having the depth h, which gradually decreases from the hub 1 toward the outer tip 2*c*, and the protrusions 24*a* to 24*c* having a height, which gradually increases accordingly.

The present embodiment therefore achieves the same operation as the first embodiment, and the air blowing performance (efficiency and air blowing noise) of the propeller fan is improved.

(Eighth Embodiment)

Figure 13:
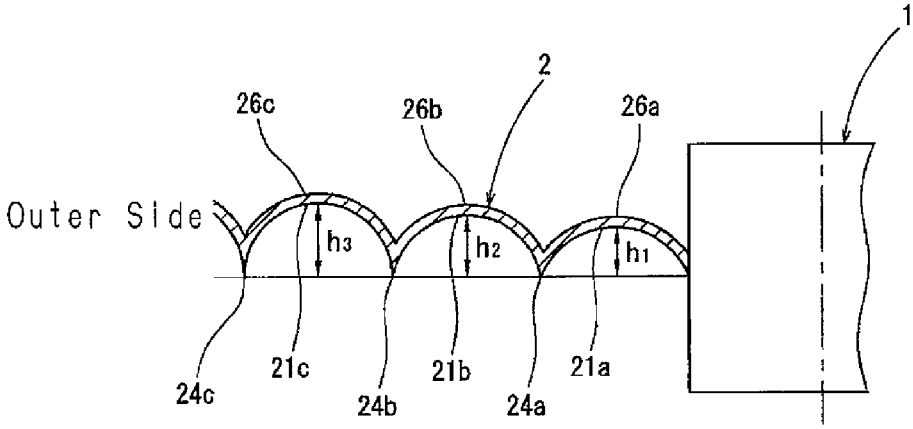
FIG. 13 is a partial cross-sectional view illustrating an impeller blade of a propeller fan according to an eighth embodiment of the present invention.

With reference to FIG. 13, a propeller fan according to an eighth embodiment of the present invention will be described.

The present embodiment is characterized and different from the seventh embodiment in that the depths of a plurality of recesses 21*a* to 21*c* are gradually increased as the distance from the hub 1 increases toward the outer tip 2*c* ($h_1>h_2>h_3$).

According to this configuration, outward flow from the hub 1 toward the outer tip 2*c*, the flow rate of which increases in accordance with an increase in the centrifugal force, can be reliably reduced by the recesses 21*a* to 21*c* having the depth, which gradually increases from the hub 1 toward the outer tip 2*c*, and the protrusions 24*a* to 24*c* having a height, which gradually increases toward the outer tip 2*c*.

The present embodiment therefore achieves the same operation as the seventh embodiment, and the air blowing performance (efficiency and air blowing noise) of the propeller fan is improved.

(Ninth Embodiment)

Figure 14:
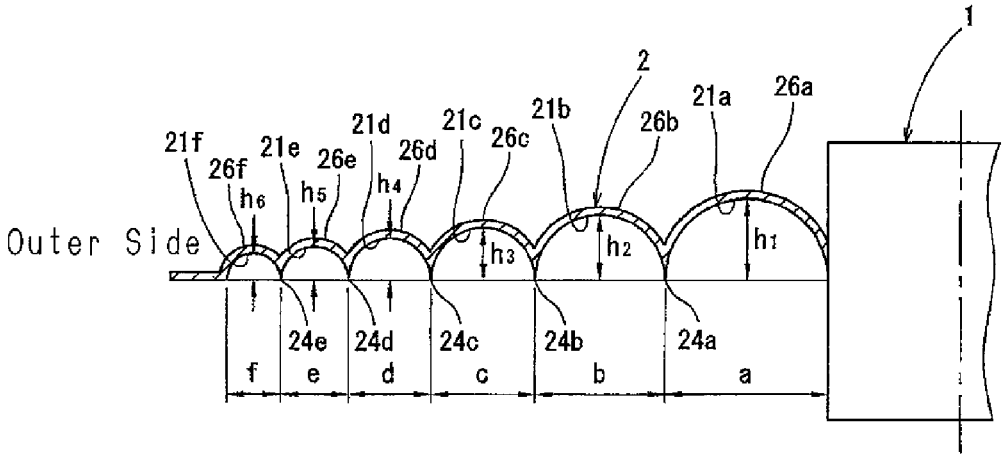
FIG. 14 is a partial cross-sectional view illustrating an impeller blade of a propeller fan according to a ninth embodiment of the present invention.
Figure 15:
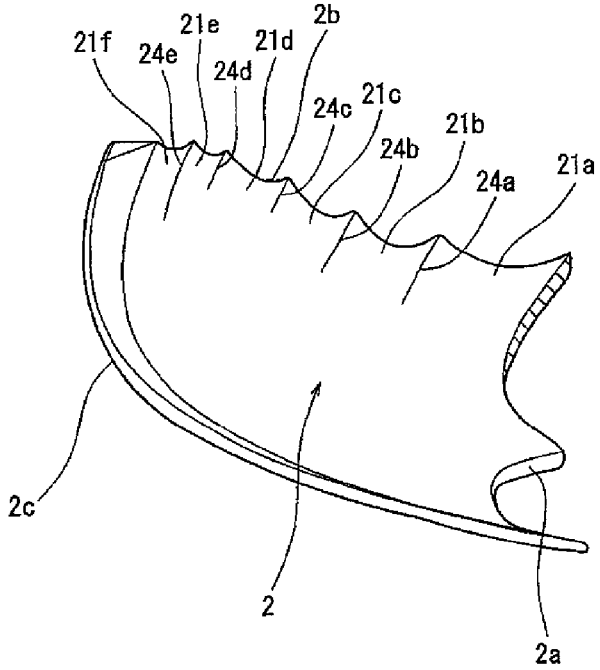
FIG. 15 is a front view showing the positive pressure surface of the impeller blade shown in FIG. 14.

With reference to FIGS. 14 and 15, a propeller fan according to a ninth embodiment of the present invention will be described.

The present embodiment is characterized and different from the first embodiment in that the radial widths a to f and the depth $h_1$ to $h_6$ of a plurality of recesses 21*a* to 21*f* both decrease as the distance from the hub 1 increases toward the outer tip 2*c*, for example, as shown in FIGS. 14 and 15 (a>b>c>d>e>f and $h_1>h_2>h_3>h_4>h_5>h_6$).

In FIG. 4, the protrusions 26*a* to 26*f* are formed on the negative pressure surface in correspondence with the recesses 21*a* to 21*e* on the positive pressure surface.

According to this configuration, outward flow from the hub 1 toward the outer tip 2*c*, the flow rate of which increases in accordance with an increase in the centrifugal force, can be reliably reduced by the recesses 21*a* to 21*f* and the protrusions 24*a* to 24*e*, the widths and depths (heights of the protrusions) of which gradually increase along the radial direction.

The present embodiment therefore achieves the same operation as the first embodiment, and the air blowing performance (efficiency and air blowing noise) of the propeller fan is improved.

(Tenth Embodiment)

In the ninth embodiment, the radial widths a to e and the depth $h_1$ to $h_5$ of the recesses 21*a* to 21*e* may be reversed from those of the ninth embodiment. The widths a to e and the depths $h_1$ to $h_5$ of the recesses 21*a* to 21*e* may be formed to increase as the distance from the hub 1 increases toward the outer tip 2*c* (a<b<c<d<e and $h_1<h_2<h_3<h_4<h_5$)

According to this configuration, outward flow from the hub 1 toward the outer tip 2*c*, the flow rate of which increases in accordance with an increase in the centrifugal force, can be reliably reduced by the recesses 21*a* to 21*e* and the protrusions 24*a* to 24*e*, the widths and depths (heights) of which gradually increase along the radial direction, as in the above embodiments.

(Eleventh Embodiment)

Figure 16:
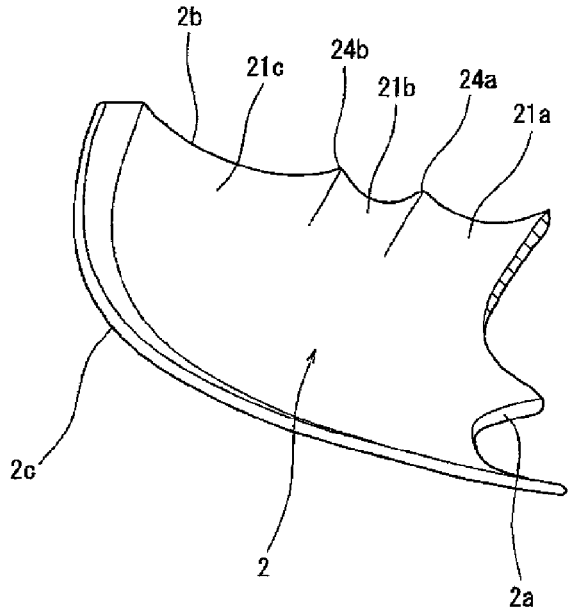
FIG. 16 is a perspective view illustrating a positive pressure surface of an impeller blade of a propeller fan according to a tenth embodiment of the present invention.

With reference to FIG. 16, a propeller fan according to an eleventh embodiment of the present invention will be described.

In this embodiment, for example, as shown in FIG. 16, the radial widths of the recesses 21*a* to 21*c* are different from those in the first embodiment. Specifically, the width c of the recess 21*c* close to the outer tip 2*c* is the greatest, and the width a of the recess 21*a* close to hub 1 is the next. The width b of the middle recess 21*b* is the smallest (c>a>b). In this manner, the present embodiment is characterized in that the radial widths of the recesses 21*a* to 21*c* are arranged irregularly. In this case, the depths of the recesses 21*a* to 21*c* may be constant or changed like the widths.

This configuration reliably reduces outward flow from the hub 1 toward the outer tip 2*c*, the flow rate of which increases in accordance with an increase in the centrifugal force.

(Twelfth Embodiment)

Figure 17:
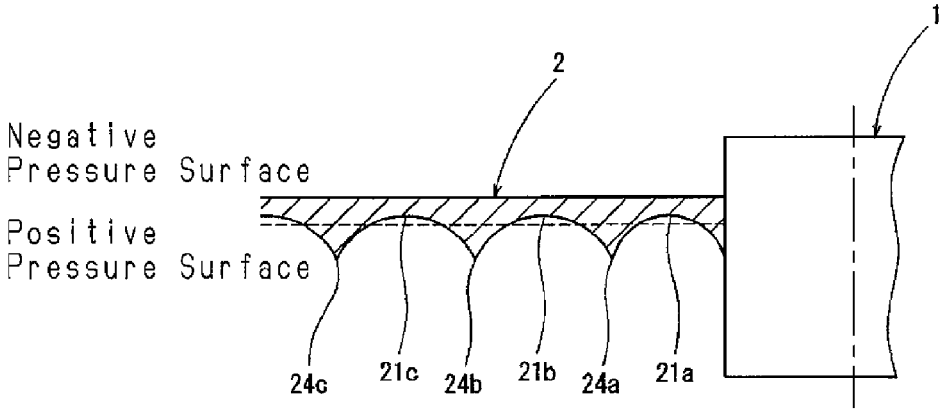
FIG. 17 is a partial cross-sectional view illustrating an impeller blade of a propeller fan according to an eleventh embodiment of the present invention.
Figure 18:
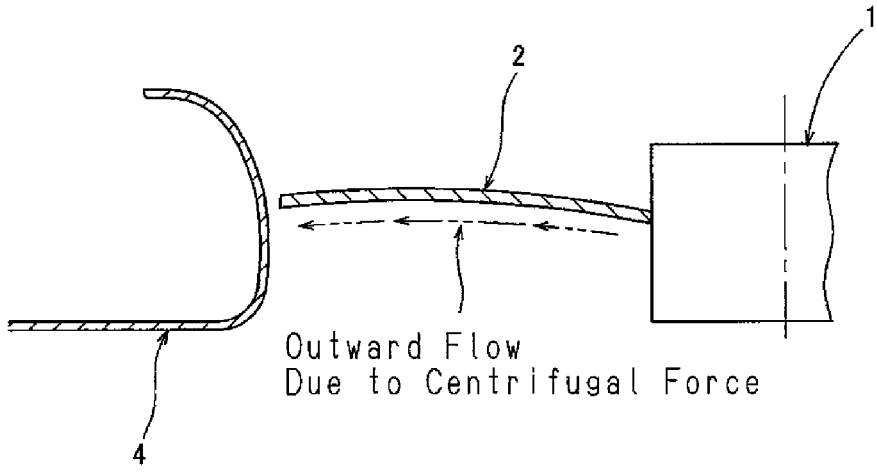
FIG. 18 is a cross-sectional view illustrating a trailing edge of an impeller blade of a conventional propeller fan, showing a first problem.

With reference to FIG. 17, a propeller fan according to a twelfth embodiment of the present invention will be described.

In the present embodiment, recesses 21 to 23 and protrusions 24, 25 are formed on the positive pressure surface of the blade 2. The present embodiment is characterized in that the negative pressure surface of the blade 2 is formed as a flat surface as shown, for example, in FIG. 17.

According to this configuration, outward flow from the hub 1 toward the outer tip 2*c*, the flow rate of which increases in accordance with an increase in the centrifugal force, can be reliably reduced by the bent surfaces of the recesses 21*a* to 21*c* and the wall surfaces of the protrusions 24*a* to 24*c*.

The present embodiment therefore achieves the same operation as the first embodiment, and the air blowing performance (efficiency and air blowing noise) of the propeller fan is improved.

The present embodiment is suitable for a fan that has thick blades 2 and is hard to bend.

(Further Embodiments)

(1) Regarding the Relationship Between the Widths a to f and the Depth $h_1$ to $h_6$ of the Recesses 21 to 23, 21*a* to 21*f* and the Shape of the Blade 2.

The widths, depths, arrangement, order of the bent surfaces (concave surfaces) of the recesses 21 to 23, 21*a* to 21*c*, 21*a* to 21*e*, and 21*a* to 21*f* shown in the above described embodiments may be changed as necessary. Also, the recesses 21 to 23 and 21*a* to 21*f* achieve a sufficient effect of reducing outward flow not only when these are arranged regularly, but also when these are arranged irregularly. The recesses 21 to 23, 21*a* to 21*f* are preferably selected and configured taking into consideration the relationship between the overall shape of the blade 2 (for example, the degree of warpage in the radial direction) to optimize the effects (for example, such that the pattern of flow matches with the warpage form of the blade 2 when the operating state changes).

(2) Regarding the Bellmouth 4

Each of the above described embodiments includes the bellmouth 4. However, the bellmouth 4 may be omitted. Even if the present invention is applied to a propeller fan having no bellmouth 4, the propeller fan functions sufficiently effectively if designed according to the concept of the present invention.

The invention claimed is:

1. A propeller fan comprising a hub coupled to a fan motor serving as a drive source and a plurality of blades provided on the outer circumference of the hub, the blades extending radially outward, the propeller fan further comprising a plurality of recesses and a plurality of protrusions, wherein the recesses adjoin each other, each have a recessed surface, extend circumferentially on a positive pressure surface at a trailing end of each blade, and are aligned in the radial direction, and wherein the protrusions are each located between adjacent two of the recesses and each of the protrusions is acute, wherein the recesses have different depths, and the depths of the recesses are formed to decrease as the distance from the hub increases and toward the outer periphery of the corresponding blade.

2. The propeller fan according to claim 1, wherein the recessed surface of the recess is a curved surface.

3. The propeller fan according to claim 1, wherein each recessed portion is a bent portion.

4. The propeller fan according to claim 1, wherein each recess has an arcuate cross-section.

5. The propeller fan according to claim 1, wherein each blade has a negative pressure surface located on the opposite side from the positive pressure surface, and where a plurality of protrusions are formed on the negative pressure surface at the trailing end of the, each protrusion corresponding to one of the recesses.

6. The propeller fan according to claim 1, wherein the recesses have different widths in a radial direction.

7. The propeller fan according to claim 6, wherein the widths of the recesses are formed to decrease in a radial direction as the distance from the hub increases and toward the outer periphery of the corresponding blade.

8. The propeller fan according to claim 1, further comprising a bellmouth adapted for surrounding the blades at a position radially outward of the blades, wherein each blade has a chord length extending from a leading edge to a trailing edge, and wherein each recess is provided in a region at the trailing edge of the corresponding blade, the region being rearward of a substantially middle point of the chord length of the blade.

9. The propeller fan according to claim 1, wherein each blade has a chord length extending from a leading edge to a trailing edge, and wherein the size of each recess gradually decreases toward middle point of the chord length, such that the recess merges into the same surface as the positive pressure surface of the corresponding blade.

10. The propeller fan according to claim 1, the recesses are formed in a part of a region ranging from 0% to 85% of the distance from the hub to the outer periphery of the corresponding blade.

11. The propeller fan according to claim 1, the recesses are formed in the entirety a region ranging from 0% to 85% of the distance from the hub to the outer periphery of the corresponding blade.

* * * * *